United States Patent [19]

Tasdemiroglu

[11] Patent Number: 4,957,034

[45] Date of Patent: Sep. 18, 1990

[54] CANDY CANE CONFIGURATION FOR MODULAR ARMOR UNIT

[75] Inventor: Server Tasdemiroglu, Oakland, Mich.

[73] Assignee: The United States of America as represented by the Secretary of the Army, Washington, D.C.

[21] Appl. No.: 451,064

[22] Filed: Dec. 15, 1989

[51] Int. Cl.[5] ..... F41H 5/04

[52] U.S. Cl. ..... 89/36.02; 109/79; 109/85

[58] Field of Search ..... 89/36.02, 36.12; 109/79, 80, 85; 114/9, 10, 11, 12

[56] References Cited

U.S. PATENT DOCUMENTS

| | | | |
|---|---|---|---|
| 860,378 | 7/1907 | Hibbard | 89/36.02 |
| 4,036,104 | 7/1977 | Pagano et al. | 89/36.02 |
| 4,677,,798 | 7/1987 | Phillips | 109/79 |

*Primary Examiner*—Stephen C. Bentley

*Attorney, Agent, or Firm*—Peter A. Taucher; David L. Kuhn

[57] ABSTRACT

Disclosed is a modular armor structure for a vehicle, the structure having an external rectangular frame containing a series of spaced parallel beams tilted and overlapping so as to form a continuous barrier against horizontally flying projectiles, the beams having a relatively flat outboard region and a curved inboard region to trap fragments and debris of projectiles shattering against the outboard region of the beams.

11 Claims, 6 Drawing Sheets

CANDY CANE CONFIGURATION FOR MODULAR ARMOR UNIT

GOVERNMENT INTEREST

The invention described herein may be manufactured, used, and licensed by or for the Government for governmental purposes without payment to me of any royalty thereon.

BACKGROUND AND SUMMARY

One problem faced by designers of military vehicles of all types is the increasing size, speed and penetrating ability of projectiles against which the vehicle must be defended. Adding more massive armor to the vehicle is not always practical since added mass makes the vehicle slower, less maneuverable and easier to hit with enemy fire. In addition, for military vehicles such as tanks, adding volume to accommodate armor renders the vehicle more difficult to transport to the theater of operations. Some modern tanks, for example, already use the entire width of cargo holds in the largest transport aircraft available.

My invention is a "candy cane" armor structure. The term "candy cane" pertains to the cross-sectional shape of spaced, overlapping beams that form part of the armor structure of a vehicle. The beams are contained in a generally rectangular frame detachedly fixed to the vehicle. The beams are tilted so that their outboard edges are lower than their inboard portions, whereby the beams form a continuous barrier against projectiles flying essentially horizontally toward the vehicle. The candy cane armor structure tends to deflect and shatter projectiles fired at the vehicle and then traps flying debris from the projectiles. For a given ability to stop a particular projectile, the candy cane armor has less weight, volume and cost than conventional armor.

DETAILED DESCRIPTION

Figure 1:
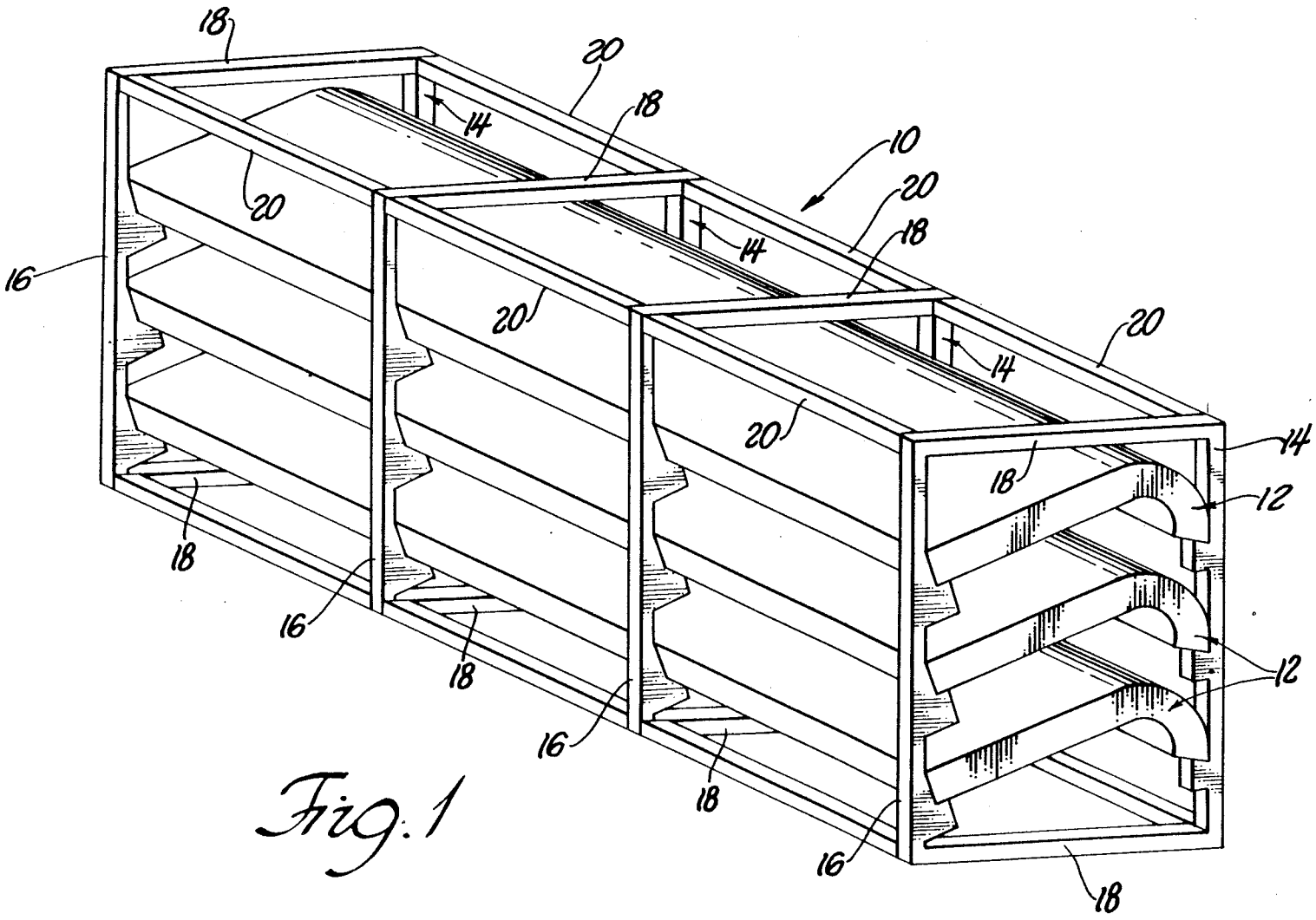
FIG. 1 is a perspective view of a modular unit of my armor.

In FIG. 1 is shown a perspective view of my armor structure 10, which is useful for protecting military vehicles. The structure has a series of relatively thin internal beams 12 disposed in spaced, parallel relation. The beams are mounted to vertical posts 14 and 16. The posts can form part of an open rectangular frame which includes transverse horizontal beams 18 and longitudinal horizontal beams 20. The armor structure 10 can be detachably fixed by any suitable means to the exterior of a tank hull (not shown) or to the exterior of any other military vehicle. Posts 14 would be on the inboard side of armor structure 10 and would be closer to the hull than posts 16.

Figure 2:
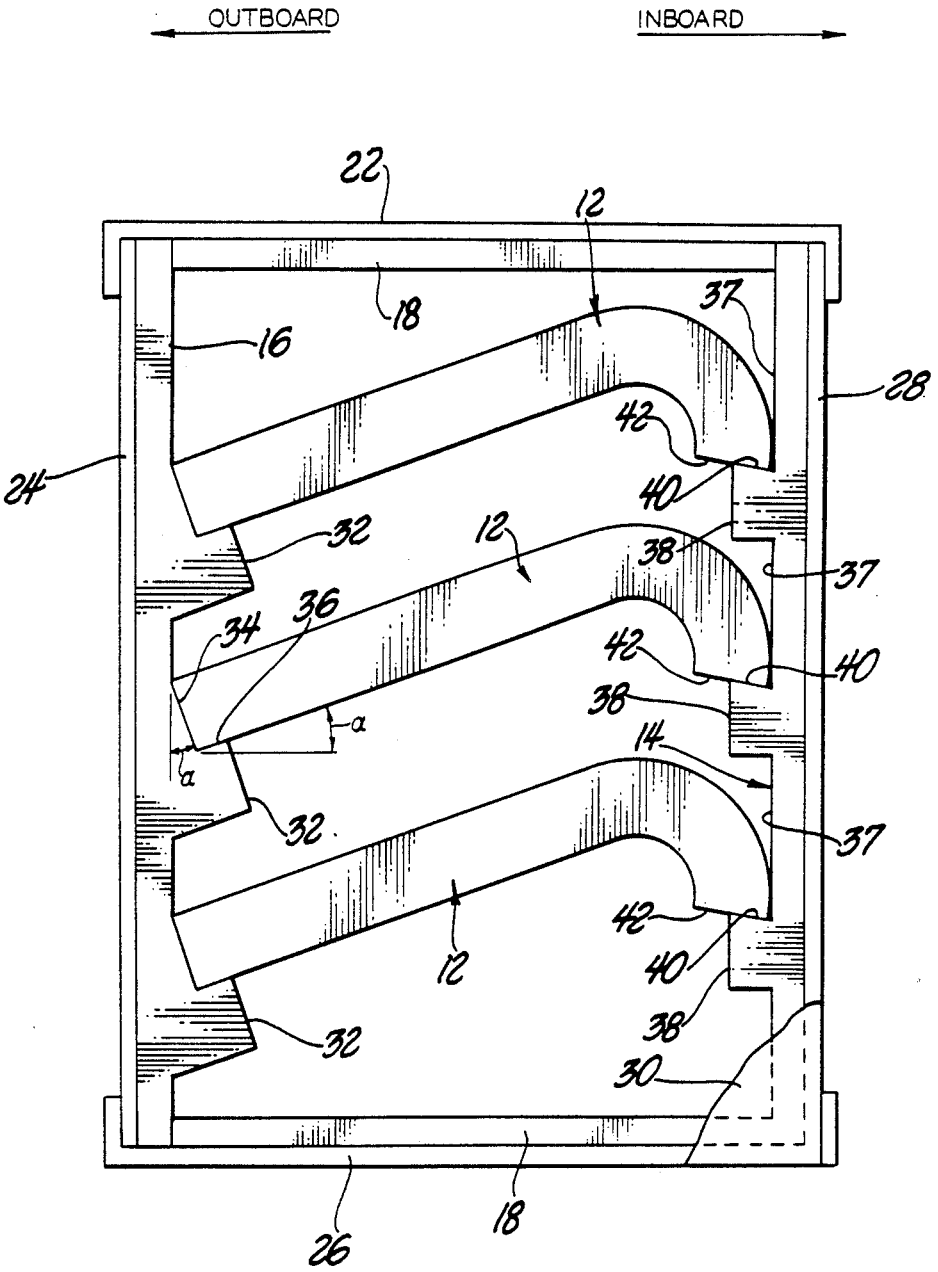
FIG. 2 is a side elevational view of the modular armor unit shown in FIG. 1, except that cover sheets are added to the top, bottom, inboard side and outboard side of the unit.

FIG. 2 is essentially an end view of the armor structure shown in FIG. 1, except that sheets 22, 24, 26 28 and 30 are added. The primary purpose of sheets 22, 24, 26 and 30 is to hide armor structure 10 from view. However, sheet 28 will also act as a spall liner for stopping inboard-bound fragments resulting from projectiles striking beams 12. The outboard side of post 16 defines a mounting surface to which sheet 24 can be bolted or welded and the inboard side of post 16 defines a series of vertically spaced mounting brackets 32 integral with the post.

Each bracket 32 has mutually perpendicular shoulders 34 and 36 against which the outboard edges of internal beams 12 closely fit. Shoulder 36, as well as the main, straight portion (section 46 in FIG. 3) of internal beam 12 form an angle "a" with horizontal beam 18, this angle preferably being between 15 and 35 degrees. It is preferred that beams 12 be affixed to the brackets by a suitable adhesive rather than by welding or by such mechanical fasteners as bolts. Adhesive is preferred firstly because beams 12 will typically be made of hardened armor steel which is difficult to weld and secondly because providing bolt holes in hardened armor steel is both difficult and potentially injurious to the integrity of the armor. Integral with inboard posts 14 are a series of brackets 38 for supporting the inboard, curved edges of the internal beams 12, the curved edges preferably being fixed by adhesive to brackets 38. Brackets 38 have shoulders 40 oriented obliquely to beam 18 so as to form an angle approximately equal to angle "a". The vertical surface segments 37 of posts 14 are just above brackets 38 and are tangent to the curved edges of internal beams 12, while shoulders 40 are in face-to-face relation to edge surfaces 42 of internal beams 12.

Figure 3:
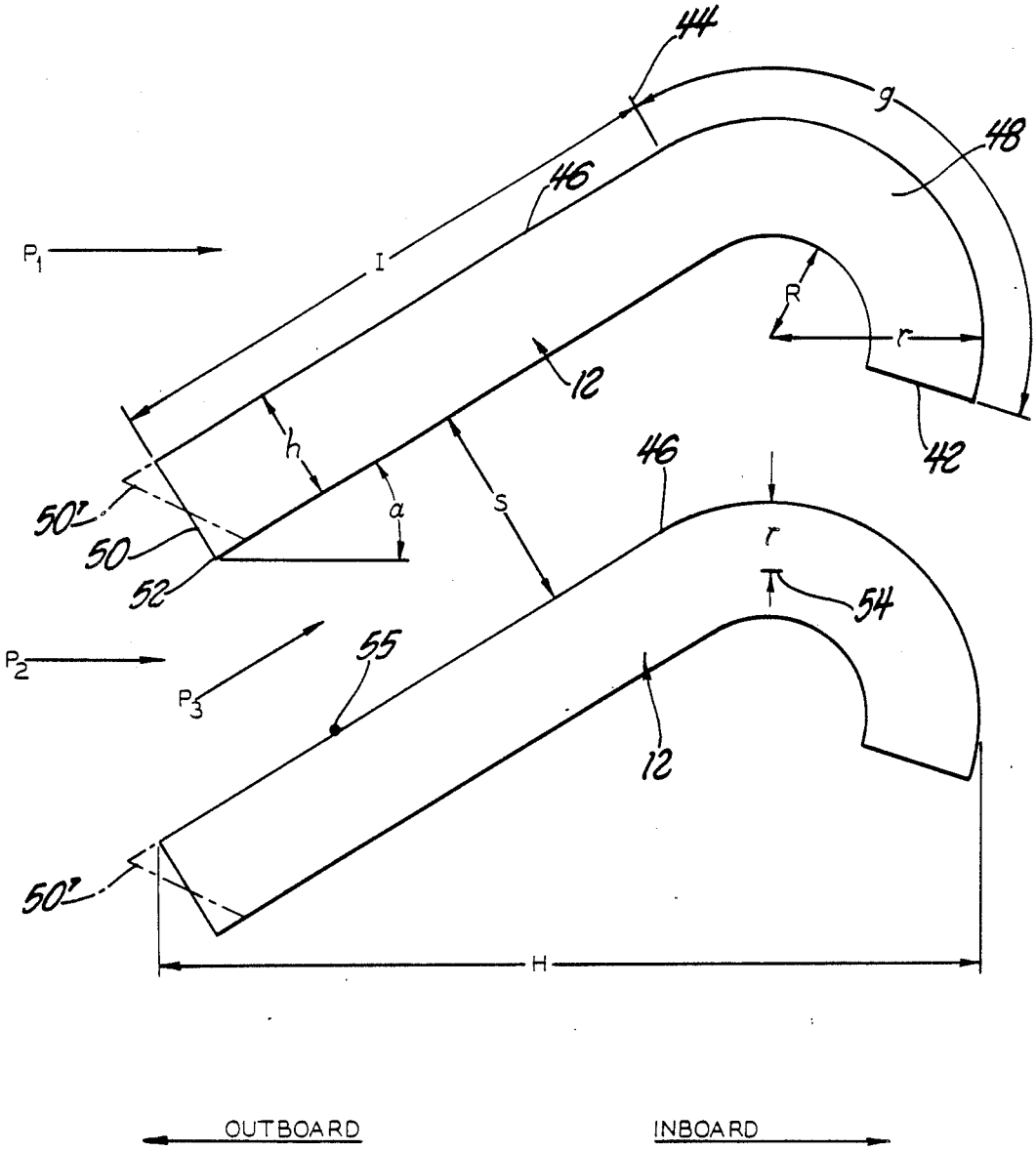
In FIG. 3 is shown a pair of cross-sectionally "candy cane"shaped beams of my armor unit.

Internal beams 12 can most conveniently be made from rolled homogeneous bar stock typically of AISI 4340 armor steel. The bar stock has one side formed into a curve 48 as shown in FIG. 3, so that beam 12 has a "candy cane" cross section. Also as seen in FIG. 3, curve 48 has an inner radius "R" and an outer radius "r", the difference between the radii being dimension "h", the thickness of the bar stock from which the beam is made. Radius "R" is preferably equal to one-half the distance "s" (FIG. 3) between neighboring beams 12. Curve 48 defines angle "g" of between 90 and 150 degrees as measured from line 44 perpendicular to the straight portion 46 of beam 12 to edge-surface 42 of beam 12, angle "g" preferably being 120 degrees.

Beams 12 are intended to to provide armor protection against projectiles travelling essentially horizontally toward the vehicle on which these beams are mounted, as, for example, along vectors $P_1$ or $P_2$. The material for beam 12, thickness "h" and the angle "a" are selected based on the known or assumed maximum penetrating ability of the set of projectile types that will be fired at the vehicle to be protected. The angle "a" controls the obliquity of beam 12, which is the deviation of the beam from perpendicularity with the horizontal path of a projectile aimed at the beam. As is known, the material characteristics (such as hardness and toughness) of the armor, thickness and its obliquity affect the armor's ability to resist penetration by projectiles or shape charges.

Once the material qualities, thickness "h" and the angle "a" have been established for beam 12, then the minimum width of the bar stock "b" from which the armor is to be made is established according to the formula:

$$b_0 = \frac{6M}{Gh^2 f}$$

where M is the moment of resistance (or strength) for the beam and G is the yield strength of the material from which the beam is made. The letter f represents a fraction whose numerator is the section modulus of beam 12 in its curved configuration as shown in the figures, the denominator of the fraction being the section modulus of the bar stock from which the beam is made. As used here, the terms "moment of resistance" (M), "section modulus," and "yield strength" have the definitions found in *Mark's Standard Handbook for Engineers*, 9th Ed., at pages 5-28 through 5-33 33. The value for "f" has been empirically determined to be 1.4222.

It has been determined that a beam 12 having a original bar stock width of $b_\phi$ or greater will not be permanently deformed by a bending along its longitudinal axis when a projectile of the assumed characteristics strikes the beam along a path approximately parallel to vectors $P_1$ or $P_2$. The struck beam does not bend away from its neighboring beam and a gap of undesired size is not formed between these beams, whereby the beams retain greater integrity as an armor structure and will have greater ability to resist subsequent strikes by incoming projectiles.

The outboard edge face 50 is oblique to horizontal vectors such as $P_1$ and $P_2$ so that edge face 50 forms an angle equal to angle "a" with a vertical line perpendicular to these vectors. It may be desired in some instances for the edge face to be oriented more nearly downward as shown in broken lines at 50', so that the edge face has greater obliquity with respect to horizontally incoming projectiles.

The corner 52 of edge face 50 of the upper one of beams 12 in FIG. 3 is horizontally aligned with reference line 54 in the lower of beams 12 in that figure. The distance "v"between reference line 54 and the top of lower beam 12 being the degree of overlap between the upper and lower beams. The distance "v" is preferably at least 10% of thickness "h" and normally need not be greater than 50% of "h". It will be noted that reference line 54 is in the intermediate zone where the curved section 48 of the beam 12 meets the straight section 46 of the beam, which zone is the horizontally thickest portion of the beam. Consequently, incoming horizontally travelling projectiles which merely graze or just miss corner 52 will hit the horizontally thickest portion of the lower beam 12. The force of such projectiles will be entirely absorbed by the intermediate zone if the projectile embeds itself in the zone. Alternatively, the force of the projectile will be partially absorbed by the zone when the projectile is deflected upward from the zone into the curved section 48 of the upper, neighboring beam 12. If the intermediate zone absorbs only part of the projectile's energy, this zone still takes enough of the energy to permit the neighboring curved section 48 to stop the projectile.

It is possible that a horizontally incoming projectile will strike the more outboard portion of straight section 46 of beam 12, as for example, at point 55 on lower beam 12 in FIG. 3. Depending on such factors as the type of projectile, the speed of the projectile, the yaw of the projectile and the hardness of beam 12, the projectile will either be stopped by embedment in lower beam 12 or it will deflect off lower beam 12 and lose some of its energy to this beam. In the latter event, the lower beam 12 takes relatively less damage and has an increased capability to stop or deflect a second strike in the same general area. Also, the projectile will often shatter, particularly if the projectile is of relatively hard, brittle material.

The deflection of the projectile is more likely to occur when straight section 46 has greater obliquity with respect to incoming rounds. Thus, preferably, angle "a" is at a value of 30 degrees or less. If the projectile shatters and deflects upward after striking point 55, it is advantageous for the projectile fragments to spray over as wide an area as possible. In this way, the remaining energy of the projectile is diffused so that a greater square area of upper beam 12 can be used to absorb this remaining energy. As a result, no single area of upper beam 12 is heavily damaged and upper beam 12 will be able to stop later hits by subsequently arriving projectiles. In order to maximize the area of upper beam 12 which absorbs upwardly deflected projectile fragments, it is preferable to maximize the distance these fragments must travel from lower beam 12 to upper beam 12, since these fragments fan out after they deflect from lower beam 12.

In view of the above considerations, care should be taken in choosing a suitable value for the distance between the upper and lower beams. I have determined that the minimum value for "s" for my armor structure can be at least approximated by the formula:

$$s_0 = \frac{b_0 + h\cot a}{Q + (\sec a)(\csc a)} - h$$

where Q is the product of angle g and the number pi (taken as 3.14159 . . . ) divided by 360 degrees. Another consideration in selecting a value for "s" is the desire that my armor structure will stop projectiles travelling on a path parallel with straight sections 46 of beam 12 and passing between these sections. Such a path could be in the direction of vector $P_3$ in FIG. 3. It is desirec that "s" will be slightly smaller than the diameter of the smallest projectile which could enter the armor structure along vector $P_3$ or a path parallel to this vector and then successfully pass through a curved section 48.

The maximum value for "s" will be the greatest value that can be tolerated in terms of desired maximum inboard-to-outboard width "H" of beams 12, the desired beam thickness "h", the desired value for angle "a" and the minimum acceptable overlap dimension "v".

Figure 4:
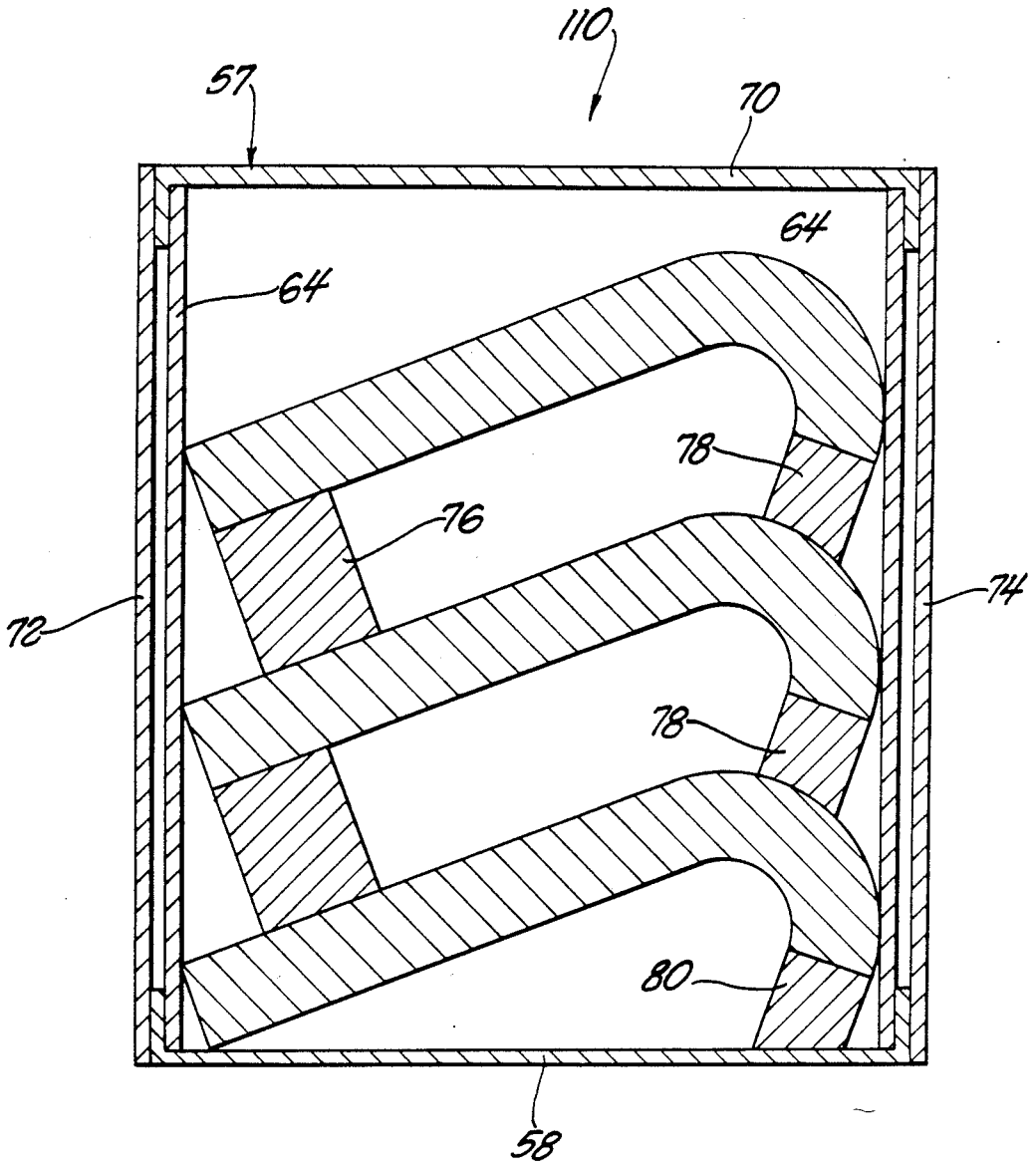
FIG. 4 is a sectional view of an alternate embodiment of my armor structure.
Figure 5:
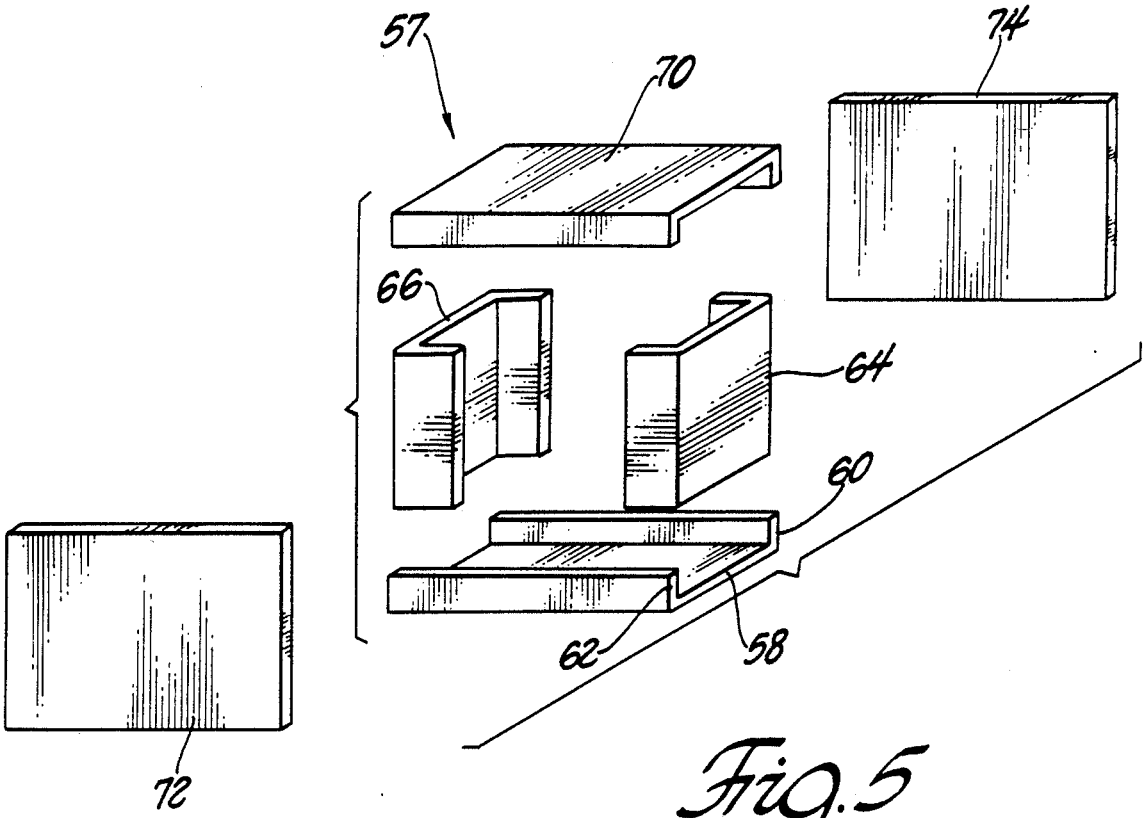
FIG. 5 is an exploded view of the box-like external frame for the alternate embodiment.
Figure 6:
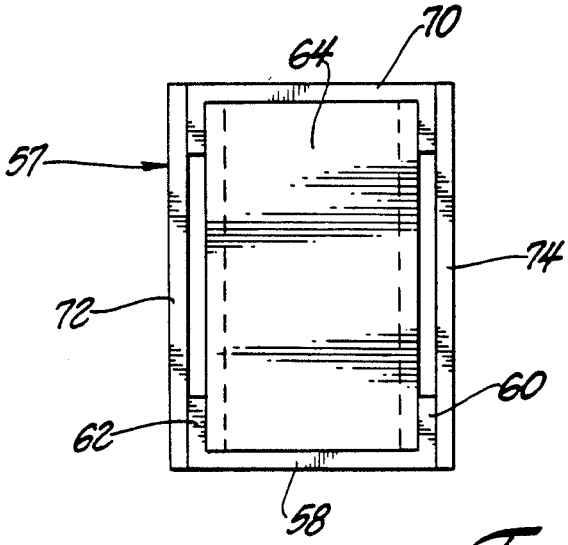
FIG. 6 is an end view of the assembled box-like frame for the alternate embodiment.

Shown in FIGS. 4 through 6 is an alternate embodiment 110 for my armor structure wherein the beams 12 are essentially unchanged from the FIG. 1 embodiment but the frame surrounding these beams differs. The closed-box frame 57 of the alternate embodiment is perhaps best understood by observing the exploded view of this frame in FIG. 5. This figure shows a lower tray 58 having an inboard flange 60 and an outboard flange 62, there being a pair of upright panels 64 and 66 which fit closely into tray 58 at either end of thereof. The tops of the upright panels fit closely into cap 70, which can have exactly the same shape configuration as tray 56. A face plate 72 covers the outboard side of frame 56 and an anti-spall plate 74 covers the inboard side of the frame. The tray, panels, cap and plates are fixed to one another typically by welding or possibly by the use of adhesives. An end view of the assembled frame 57 is shown in FIG. 6.

FIG. 4 shows how beams 12 are retained in closed-box frame 57, the beams being prevented from moving inboard or outboard by the flanges of upright panels 64 and 66. Between the outboard portions of any two neighboring beams 12 are spacers 76 fastened by a suitable adhesive to the beams. Fixed by an adhesive between outboard portions of neighboring beams 12 are trapezoidal spacers 78, there being another trapezoidal spacer 80 between the lowest of beams 12 and tray 62. Face plate 72 may be of extremely hard armor steel which will fragment when a projectile having relatively high kinetic energy strikes it. Inboard flying debris resulting from the strike will have received some of the impact or energy of the projectile and will spray out over an area greater than the cross-sectional area of the projectile. Consequently, damage of lesser concentration occurs to beams 12 and they will therefore be more capable of stopping subsequently striking projectiles. Anti-spall plate 74 shields the vehicle to which armor structure 110 is attached from any flying debris that may glance off plates 12 and enter the gaps between the inboard edges of the beams. By the time the debris arrives at plate 74, it will have lost most of its energy, so that plate 74 need only be a sheet-like wall in order to effectively stop the debris.

Figure 7:
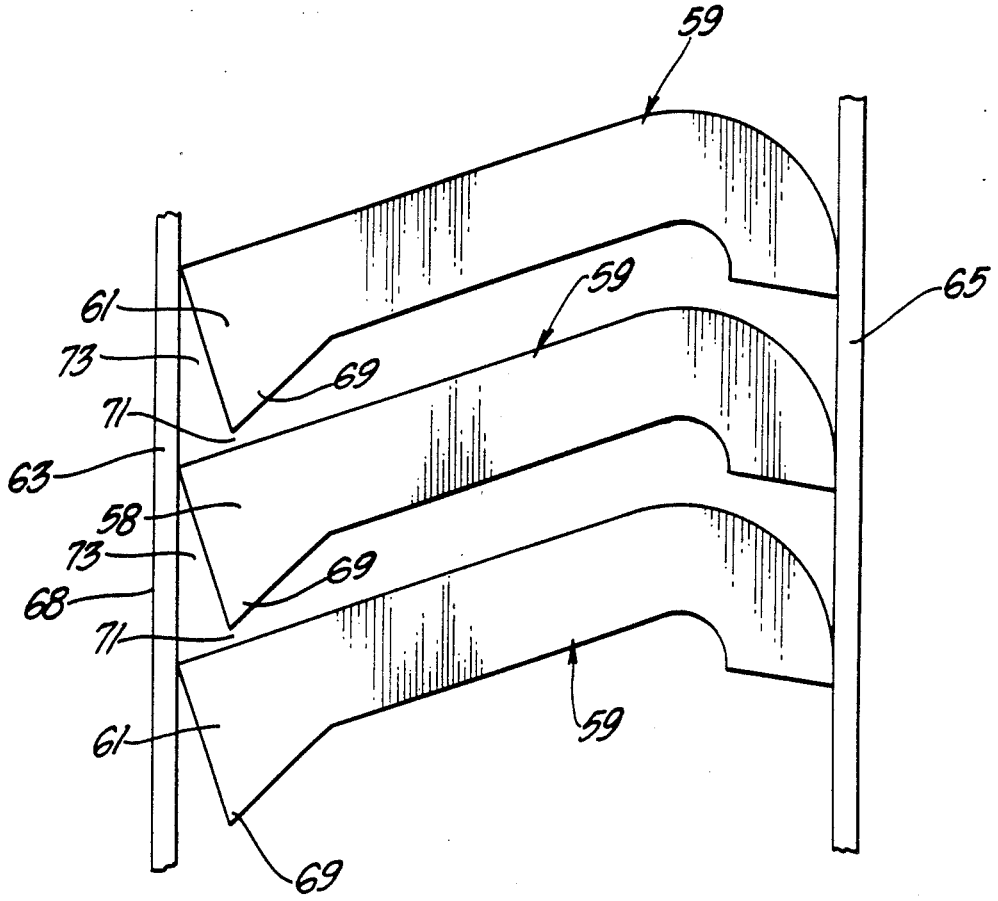
FIG. 7 shows an alternate embodiment of my invention.

FIG. 7 shows a further embodiment of my armor that is especially adapted to defeat weapons such as rockets or torpedoes which explode upon impact with a target. Such an armor construction could be used on ship hulls to prevent mine explosions or torpedoes from penetrating the hulls.

This embodiment of my armor includes internal beams 59 which are similar to internal beams 12 shown in FIGS. 1 and 2, except that beams 59 are enlarged at the outboard zones 58 so as to form downwardly pointing projections at 69. The outboard edges of the internal beams form pockets 73 open at restricted orifices 71. Internal beams 59 can be held in position by brackets and/or frame members (not shown in FIG. 7) in a manner similar to that shown in FIGS. 1 and 2. An outboard wall 63 is fixed over the outboard edges 61 of internal beams 59. An inboard wall 65 is fixed to the curved in board edges of internal beam 59. Wall 65 can be attached to the hull of a ship or tank or can form an integral part of the hull.

When ordinance such as an impact explosive torpedo strikes outboard wall 63, at a given point 68, the force of the resulting explosion will blow a hole in wall 63. The explosion will create an instantaneous overpressure in the pocket, which will tend to force the torpedo or like ordinance outboard from the internal beams 59. The instantaneous overpressure will not be sufficiently relieved by orifices 71 to appreciably inhibit its tendency to repulse impact explosive torpedoes, rockets, and the like.

I wish it to be understood that I do not desire to be limited to the exact details of the constructions shown and described herein since obvious modifications will occur to those skilled in the relevant art without departing spirit and scope of the following claims.

I claim:

1. A modular armor structure for attachment to a military vehicle wherein the vehicle has a top, a bottom, and sides connecting the top and bottom, the modular armor being attached to one of the sides and comprising:

a frame;

a horizontal reference plane passing through the frame;

a plurality of vertically spaced internal beams mounted inside the frame and extended along the side of the vehicle, the internal beams having an outboard portion more distal from the side of the vehicle than an inboard portion of the internal beams, the outboard portions having wide straight cross sections which are parallel with one another and which are oblique to the horizontal reference plane, the inboard portions of the internal beams having arcuate cross sections whose radial thickness is approximately equal to a cross sectional thickness of the outboard portions, the arcuate cross section defining an inside curve whose radius of curvature is approximately equal to one-half the distance between straight cross sections, the angular dimension of the arcuate cross section being between 90 degrees and 150 degrees;

wherein the minimum sum of the average arc length of the arcuate cross section and width of the straight cross section is approximated by the formula $$b_\phi = \frac{6M}{G\,h^2\,g}$$

where $b_\phi$ is the minimum sum, M is the desired moment of resistance of the internal beam, G is the yield strength of a metal from which the internal beam is made, h is the thickness of the outboard portion of the internal beam, and g is a constant number.

2. The armor structure of claim 1 wherein g is a fraction whose numerator is the section modulus of a cross-sectionally flat rectangular beam and whose numerator is the section modulus of a reference internal beam;

the flat rectangular beam having a given width and a given thickness;

the flat rectangular beam having the same thickness as the cross-sectional thickness of the outboard portion; there being a reference sum consisting of the average arc length of the arcuate section of the reference internal beam and the width of the outboard portion of the reference internal beam;

the reference sum being equal to the given width of the flat rectangular beam.

3. The armor structure of claim 1 wherein the internal beams define uniform spaces therebetween, the minimum width of the spaces being determined by the formula $$s_0 = \frac{b_0 + h\cot a}{Q + (\sec a)(\csc a)} - h$$

where $s_\phi$ is the minimum width, "a" is an acute angle that the internal beams form with the horizontal reference plane and "Q" is the product of pi and the angular dimension of the arcuate cross section divided by 360 degrees.

4. The armor structure of claim 1 wherein the internal beams have an intermediate zone at which the inboard portions integrally join the outboard portions and wherein a lower edge of the outboard portion is aligned with a section of the intermediate zone in a secondary plane parallel with the reference plane.

5. The armor structure of claim 3 wherein the intermediate zone extends above the secondary plane by a distance which falls within the range of 10% and 50% of the cross-sectional thickness of the outboard portions.

6. The armor structure of claim 1 wherein the the outboard portion has an outboard surface facing outward and downward relative to the vehicle so that the surface is oblique to the horizontal reference plane.

7. The armor structure of claim 1 including means for releasably attaching the frame to the vehicle.

8. The armor structure of claim 1 wherein the frame includes two rectangular subframes parallel to the reference plane and posts perpendicular to the reference plane connecting the subframes together, the posts having shoulders upon which the internal beams are supported.

9. The armor structure of claim 8 wherein the internal beams are fastened to the posts by an adhesive.

10. The armor structure of claim 1 wherein the frame includes a an exterior metal sheet covering the outboard side of the frame, and an inboard sheet fixed to the internal beams and disposed between the internal beams and the vehicle.

11. The structure of claim 10 wherein the internal beams are separated by spacers, the spacers being disposed between the internal beams and fixed thereto by an adhesive.

* * * * *